United States Patent [19]

Savich

[11] 4,281,854

[45] Aug. 4, 1981

[54] INTEGRATED BOOK LINING

[75] Inventor: Peter P. Savich, Longmeadow, Mass.

[73] Assignee: The Smyth Manufacturing Company, Bloomfield, Conn.

[21] Appl. No.: 103,863

[22] Filed: Dec. 14, 1979

Related U.S. Application Data

[63] Continuation of Ser. No. 882,912, Mar. 6, 1978, abandoned, which is a continuation-in-part of Ser. No. 785,965, Apr. 8, 1977, abandoned.

[51] Int. Cl.[3] ..... B42D 3/00; B42C 11/00

[52] U.S. Cl. ..... 281/21 R; 11/5; 156/227; 428/121; 428/122; 428/123; 428/131; 428/192

[58] Field of Search ..... 428/126, 132, 192, 194, 428/121, 122, 123, 131, 296, 68; 281/21 R, 29, 36, 20, 23, 5, 28; 11/1 R, 2, 3, 5; 427/140; 156/94, 216, 227; 93/1 R, 1 G, 1 F

[56] References Cited

U.S. PATENT DOCUMENTS

| | | | |
|---|---|---|---|
| 1,665,049 | 4/1928 | Baker | 281/28 |
| 3,231,296 | 1/1966 | Margolis | 281/29 |

*Primary Examiner*—Paul J. Thibodeau
*Attorney, Agent, or Firm*—Hayes & Reinsmith

[57] ABSTRACT

A lining to be applied to a spine of a book is disclosed wherein the lining is characterized by an integrated construction of a tough, relatively lightweight, durable, synthetic sheet exhibiting dimensional stability, good printability and good ink adhesiveness and which has printed simulated headbands at its opposite ends. The lining has a maximum length corresponding to the length of a book spine to which the lining is to be applied and the extent of the printed headbands correspond to the thickness of the book to which the lining is to be applied.

11 Claims, 20 Drawing Figures

FEED

TRIM

PRINT

SCORE

GLUE

APPLY CORD AND EDGE FOLD

HEAT

PUNCH

CUT

GLUE

EDGE FOLD

HEAT

CORNER RELIEF

PERFORATE

CUT

INTEGRATED BOOK LINING

This is a continuation of application Ser. No. 882,912, filed Mar. 6, 1978 now abandoned, which application is a continuation in part of application Ser. No. 785,965 filed Apr. 8, 1977, now abandoned.

This invention generally relates to the bookmaking art and specifically concerns a so-called integrated lining for the spine of a book.

A primary object of this invention is to provide a new and improved integrated lining to be applied to a spine of a book.

Another object of this invention is to provide such an integrated lining which is quick and easy to manufacture and to apply to a spine of a book at significantly reduced cost.

A further object of this invention is to provide a new and improved integrated lining particularly suited to be applied for securing fillers such as conventional signatures of a book, e.g., in assembled relation prior to casing-in the book and which is particularly suited to be made in a low cost, high speed bookmaking operation.

Other objects will be in part obvious and in part pointed out more in detail hereinafter.

A better understanding of this invention will be obtained from the following detailed description and the accompanying drawings of an illustrative application of this invention.

BRIEF DESCRIPTION OF THE DRAWINGS

In the drawings:

Referring to the drawings in detail, a conventional three element combination lining construction for a book is illustrated in FIGS. 1 and 2. FIG. 1 shows various parts of a disassembled lining. A conventional woven material commonly referred to as "crash" 10, similar to a tough, coarse cheesecloth, is glued to the book 12 with side flaps 14 of the crash 10 lapping over a crowned spine 16 and extending along each face sheet 18 of the book 12. The extent of the crash flaps 14 along the face sheets 18 typically measure about $\frac{7}{8}$ inch such that the overall width of the crash 10 is equal to two times $\frac{7}{8}$ plus the thickness of the spine 16. The crash 10, which is glued to the book spine 16, has individually customized headband strips 20 applied by yet another separate gluing operation to a conventional backing 22, normally so-called "kraft" paper. The backing 22 is applied in registered relation to the book spine 16 and overlaps both the headband strips 20 and underlying crash 10 to form the conventional lining for the book, it being understood that the backing 22 again is required to be applied to the spine 16 by yet a further gluing operation.

The above described conventional lining utilizes three separate and costly materials in addition to multiple layers of adhesives all of which have become increasingly expensive. The per unit cost of books can be significantly reduced by simply eliminating multiple gluing operations and even more significant cost savings are achieved by the elimination of the above described conventional three element backlining. Concomitant cost savings have been found to be achieved by eliminating conventional machine components and the normally required multi-operational steps by providing an integrated lining in accordance with this invention.

In FIGS. 3–11, inclusive, individual manufacturing steps are graphically illustrated in the method of making the integrated lining of this invention. The lefthand column of each of the figures designated "A" depicts an outer surface 24A of a strip 24 of lining material. The righthand column of the respective figures designated "B" represent an opposite inner strip surface 24B. It is to be understood that the method of making the integrated linings of this invention entails manufacture of a series of identical linings to be ultimately attached to a succession of books each of identical size corresponding to the linings. Adjustment of the lining size is readily made before a production run during machine set up for books of particular sizes.

Figure 1:
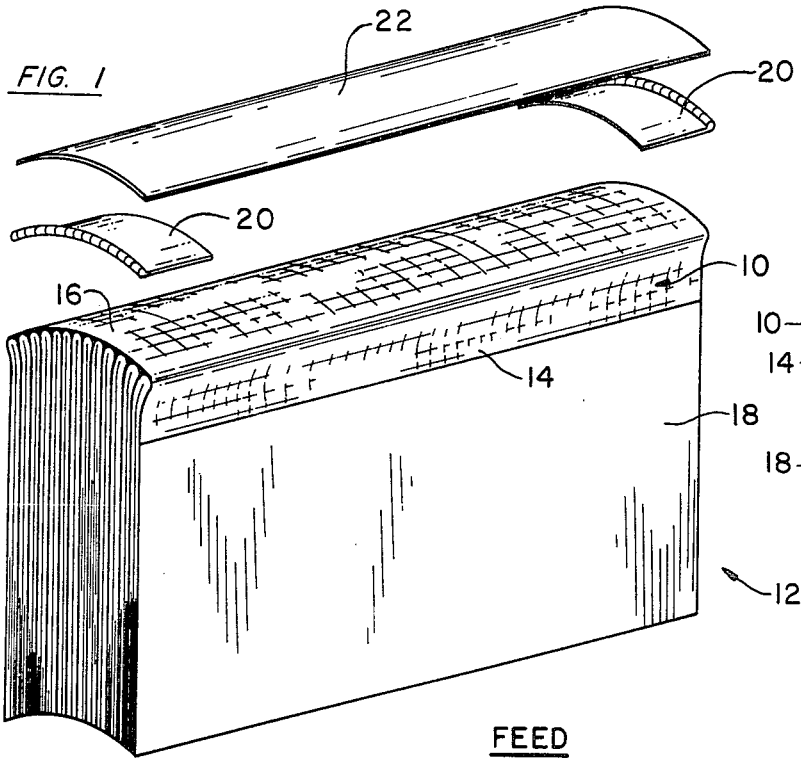
FIG. 1 is an isometric view showing parts of a conventional lining in disassembled relation to a book.
Figure 2:
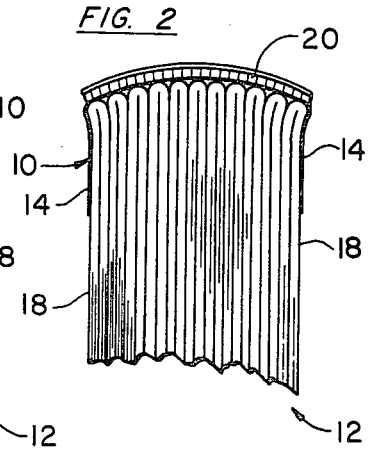
FIG. 2 is an end view, partly broken away, of a book having a conventional lining applied of the type illustrated in FIG. 1.
Figure 3A:
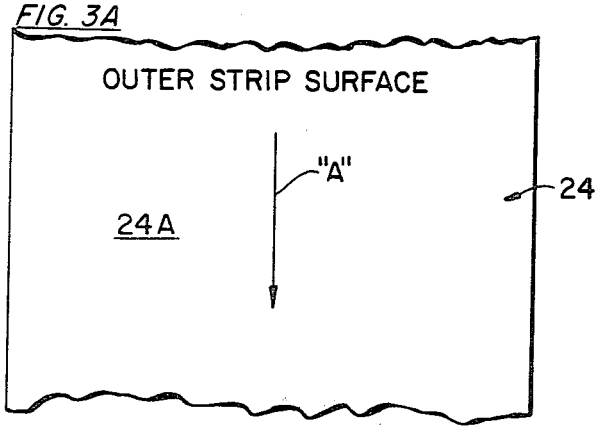
FIGS. 3A through 11B inclusive are diagrammatic representations of steps in making a lining of this invention.
Figure 3B:
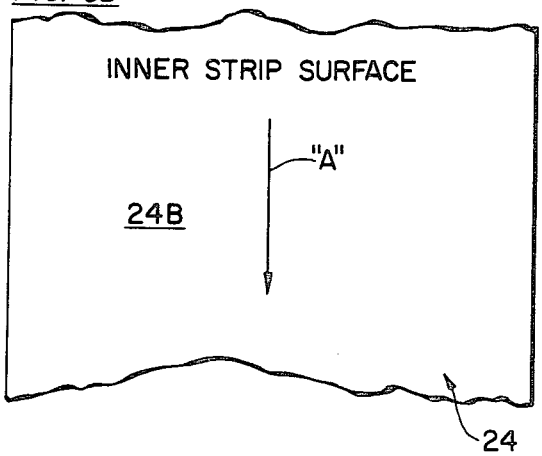
Figure 4A:
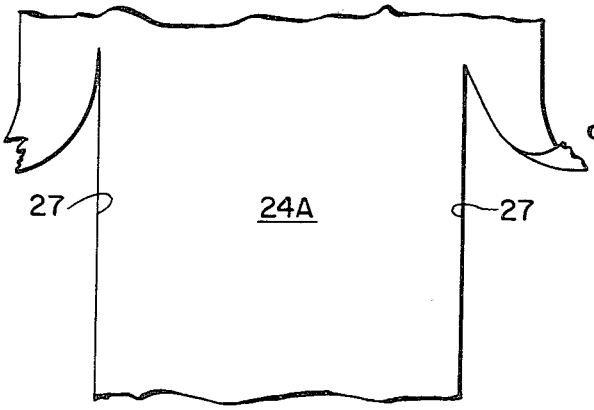
Figure 4B:
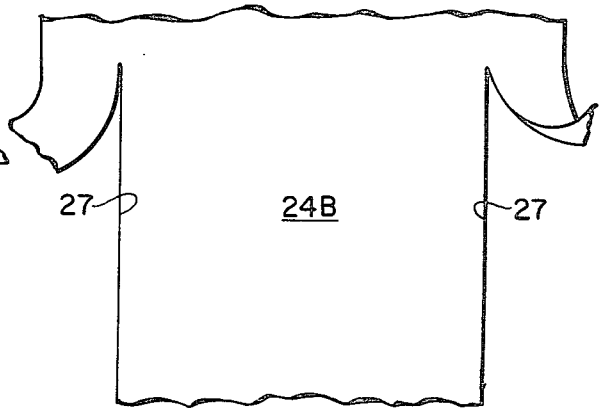

Strip stock is paid-off a supply roll to be fed along a feed path extending in the direction of the longitudinal axis of the strip in the direction of arrows "A" in FIG. 3 through a series of progressive operational stations. The strip stock material may be any one of a number of selected tough, durable webs or sheets of relatively lightweight construction exhibiting dimensional stability under varying atmospheric conditions, good printability and good ink adhesiveness. While various types of materials are suited for the application of this invention, a synthetic material found to perform satisfactorily is a spunbonded olefin of high density polyethylene fibers marketed under the trademark "Tyvek" by E. I. duPont de Nemours and Co., Inc. Tyvek spunbonded olefin exhibits lightweight, smooth surface and high opacity characteristics as well as being tough and durable and is suited to provide a printable substrate in either web or sheet form.

Figure 5A:
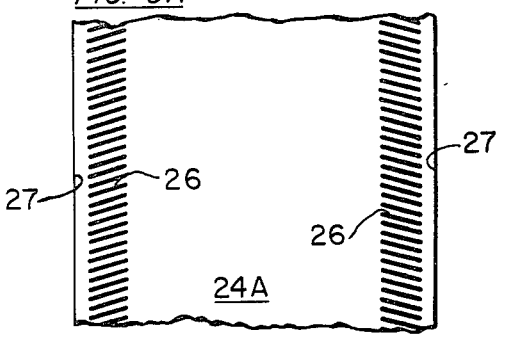
Figure 5B:
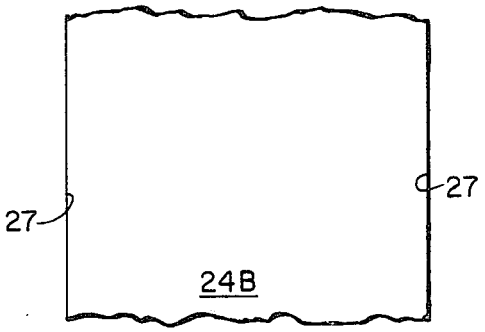
Figure 6A:
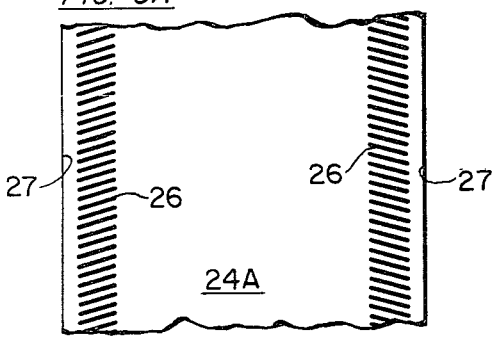
Figure 6B:
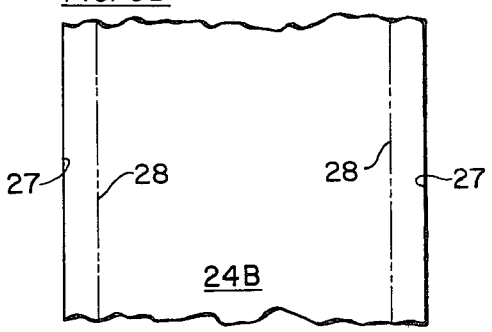

Upon paying off a strip of such material, the strip 24 is trimmed (FIG. 4) to a width generally corresponding to the length of the book spines to which the integrated lining is to be applied, plus twice a predetermined fold-over as described below. After trimming, the strip 24 is then fed to a downstream printing station. At the printing station, the outer surface 24A of the strip 24 is printed to form a continuous pattern 26 of simulated headbands parallel to and adjacent each longitudinal edge 27 of the strip, as best seen in FIG. 5, before the strip 24 is fed into a crimping station.

At the crimping station, fold lines 28 (FIG. 6) are scored on the strip within the printing zones or patterns 26 of its simulated headbands in adjacent parallel relation to each of its longitudinal edges along the inner surface 24B of the strip opposite its printed surface. The scoring is effected to provide fold lines 28 spaced apart a distance substantially equal to the length of the book spines which are to be provided with backlinings.

Figure 7A:
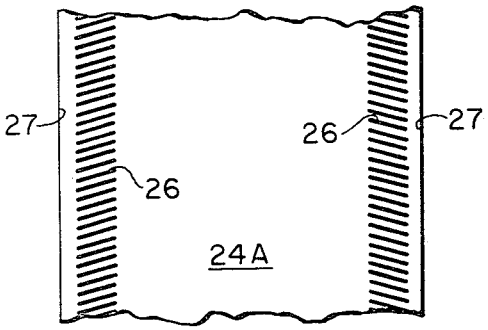
Figure 7B:
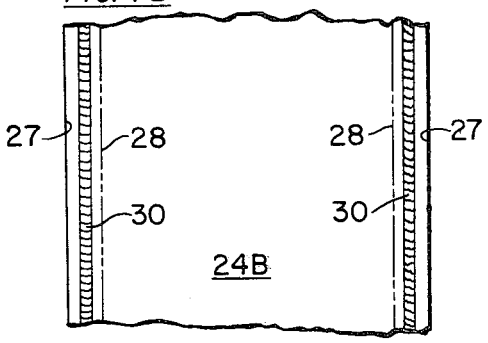
Figure 8A:
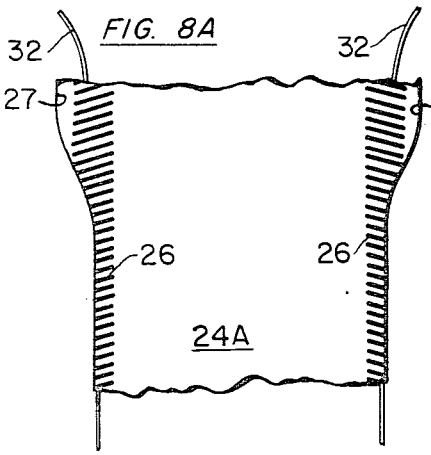
Figure 8B:
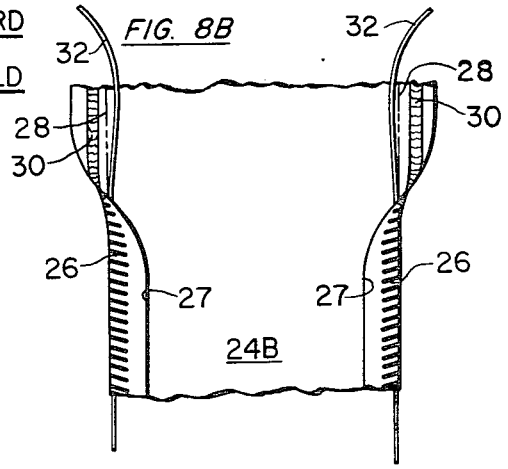
Figure 9A:
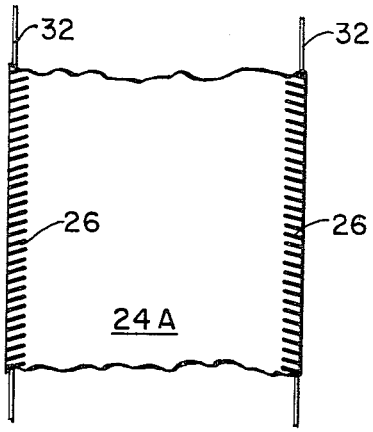
Figure 9B:
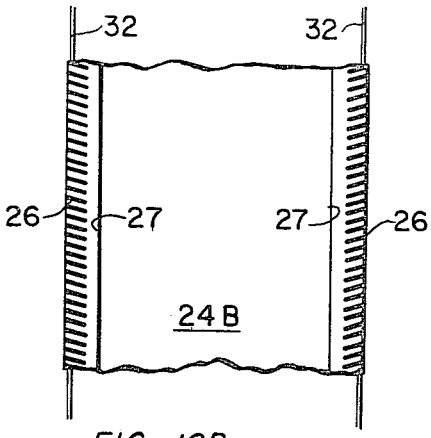
Figure 10A:
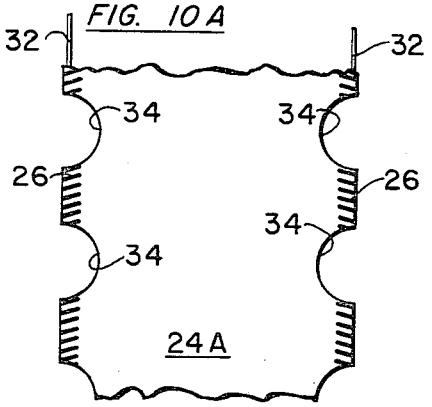
Figure 10B:
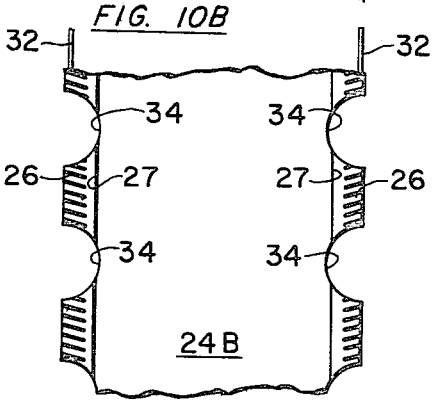
Figure 11A:
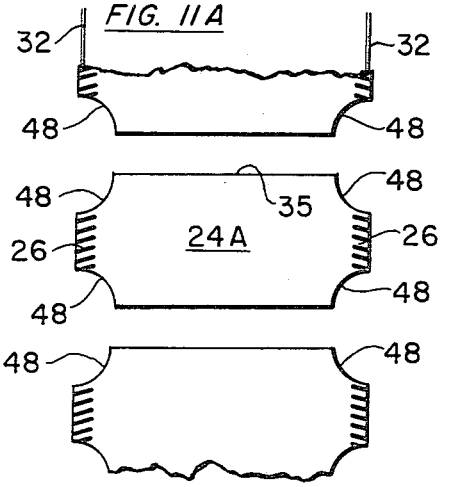
Figure 11B:
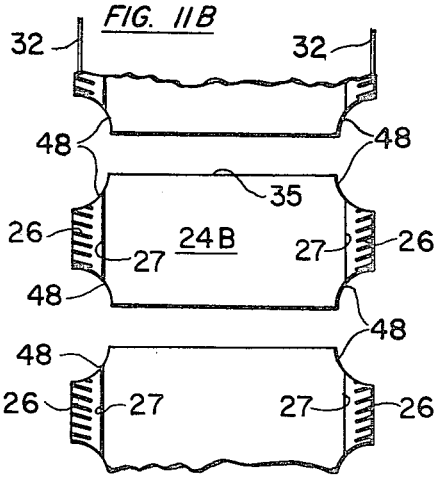

The strip 24 then passes through an adhesive applicator which preferably applies a hot melt adhesive in a continuous thin molten bead 30 in parallel relation to the longitudinal side edges on the inner surface 24B of the strip 24 (FIG. 7). In the preferred embodiment, the adhesive beads 30 along each strip side edge are illustrated as being disposed between their respective side edge of the strip and adjacent scoring line 28.

The trimmed, printed and scored strip 24 is then fed to a downstream edge folding station (FIG. 8), and the glue laden inner side edges of the strip 24 are folded toward one another. By folding over the side edges of the strip along their scored fold lines 28, the outer printed edge surfaces are exposed to simulate headbands on each side of the lining at its opposite edges, respectively, with a folded strip dimension extending crosswise of the strip's longitudinal axis substantially equal to the book spine length.

To provide desired added bulk to the simulated headbands, cord 32 is preferably fed onto the inner surface of the strip 24 along each of its side edges to be drawn through the folding station in unison with the strip such that the cord 32 is secured along the fold lines 28 within each folded edge upon the adhesive bonding the confronting inner folded surfaces at opposite side edges of the strip 24.

A property of Tyvek spunbonded olefin is a melting point of about 275° F. Available hot melt adhesives normally have significantly higher melting point temperatures than spunbonded olefin and many other suitable lining materials. By introducing a short time delay during transfer of adhesive at its melting temperature, say at 375° F., before applying it to the Tyvek strip permits the hot melt adhesive to cool to a reduced temperature, say, of about 275° F., before being applied to the lining. Despite its relatively low melting point, the Tyvek material has not been found to melt through since only its confronting inner surfaces are drawn into direct contact with the hot melt through the folding station. The hot melt adhesive not only cools rapidly but provides a bond very quickly.

It has also been found that use of hot melt adhesives having significantly reduced melting points approaching that of the lining material does not effectively bond the edges. However, by applying heat (FIG. 9) to the lining material and its hot melt (having similar melting points) downstream of the edge folding station serves to reactivate or remelt the adhesive to securely seal the folded edges in position.

To effect stress relief at each corner of the side flaps of the integrated lining of this invention as well as to promote improved adhesion of the lining to the book, the strip upon passing through the hot melt reactivating heating zone is fed into a punching station wherein equally spaced marginal cutouts 34 of substantially identical size are formed along each longitudinal side edge of the strip (FIG. 10) with the spacing between side edges measuring about $1\frac{3}{4}$ inch. The cutouts 34 on each edge of the strip are formed in opposed aligned relation to cutouts on the opposite edge of the strip. To match the simulated headbands to the ends of the book spines, the cutouts 34 are spaced apart to provide uniform uninterrupted longitudinal side edges between cutouts which are substantially equal in length to match the thickness of the book spines to which the linings are to be applied.

The lining material then moves into a cutting station wherein the strip is cut (FIG. 11) transversely to its longitudinal axis along a cutoff line 35 projecting between centers of the aligned cutouts on opposed strip edges to form substantially identical individual linings to be attached to book spines of substantially identical size.

Figure 12:
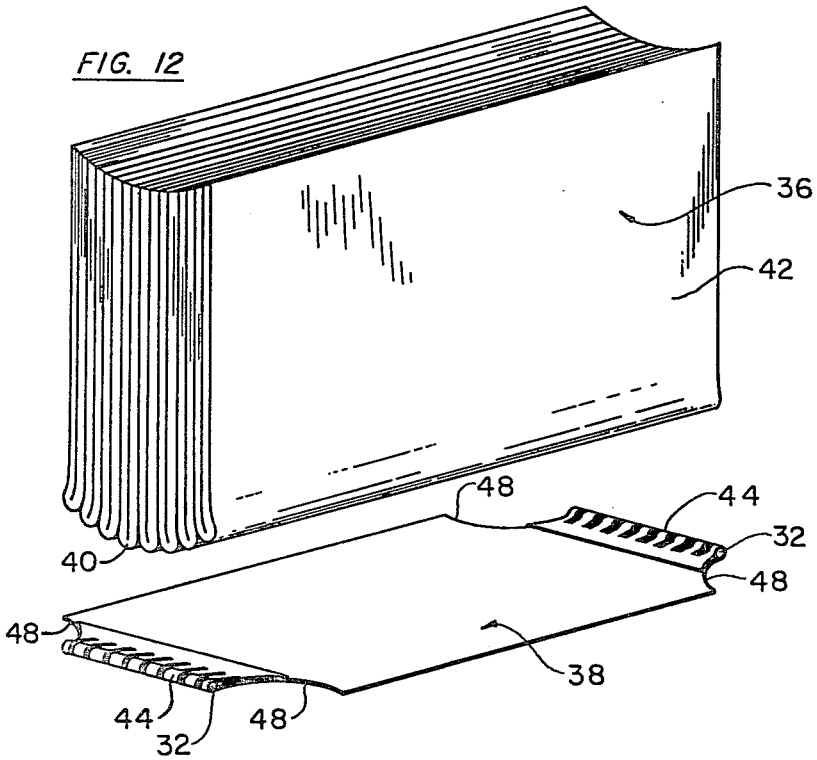
FIG. 12 is an isometric view of a book and an integrated lining of this invention in disassembled relation prior to being joined in registered relation to one another.
Figure 13:
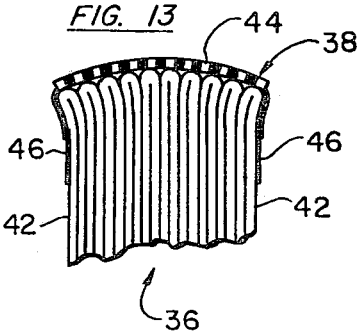
FIG. 13 is an end view of a book, partly broken away, which has an integrated lining applied thereto according to this invention.
Figure 14:
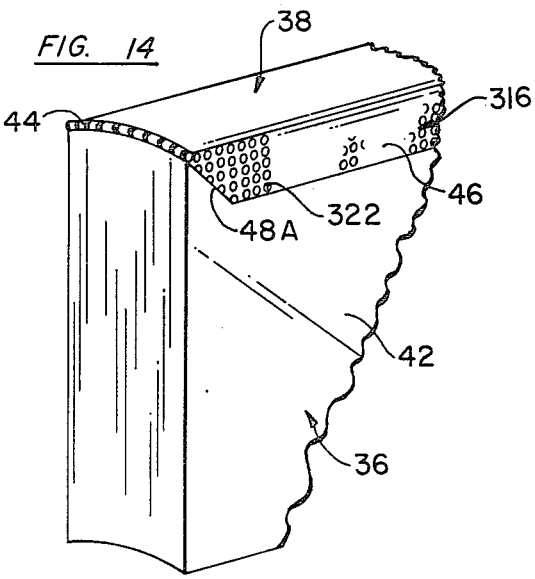
FIG. 14 is an isometric view, partly broken away, of another embodiment of an integrated lining of this invention in assembled relation to a book.

Referring now to FIGS. 12 and 13, it will be understood that a series of books such as at 36 are each conveyed to a conventional lining station in synchronism with a corresponding series of linings 38 successively being fed onto a lining platform from the cutting station. Each book 36 arrives at the lining station with its crowned spine 40 and adjacent face sheets 42 coated with glue for attachment of a lining such as at 38 with its simulated headbands 44 registered with opposite ends of the spine 40 and the relieved side flaps 46 of the lining 38 extending along each face sheet 42.

As noted above, when the strip 24 moves through the punching station the cutouts are preferably formed by a circular punch, and the cutouts 34 so made serve to relieve the opposite ends of each of the lining side flaps 46 projecting beyond the headbands 44 to extend beyond the spine 40 of the book 36 and down along its face sheets 42. Such construction not only removes the ends of each flap 46 to promote better gluing of each flap to its face sheet, but needed stress relief is provided at each corner of the crowned book spine 40 in addition to providing a better appearance than would otherwise be achieved if the extending flaps were even with the simulated headbands.

The integrated lining 38 of this invention is accordingly formed from substantially planar strip stock and the ends of the lining on opposite sides of each simulated headband 44 are relieved with corner cutouts 48. The uninterrupted extent of the simulated headbands 44 extending between the corner cutouts 48 is substantially equal to the thickness of the book spine 40; the flap 46 on each side of the headbands 44 extends about $\frac{7}{8}$ inch, which usually results in a lining having a width between opposed side edges thereof which is less than its folded length; and the length of the lining 38 between the simulated headbands 44 is substantially equal to the length of the book spine to which the lining 38 is to be applied. Desired bulk for each simulated headband 44 is provided by the cord 32 extending along each of the fold lines 28 at opposite ends of each integrated lining 38.

Figure 15A:
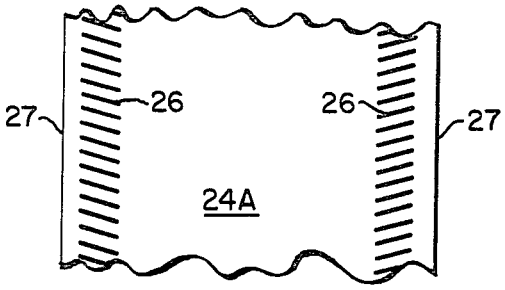
FIGS. 15A through 20B inclusive diagrammatically illustrate another embodiment of a series of steps in making a lining of this invention.
Figure 15B:
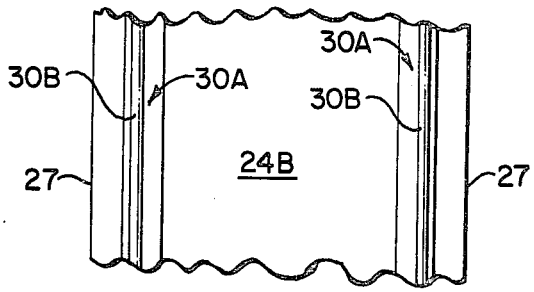
Figure 15C:
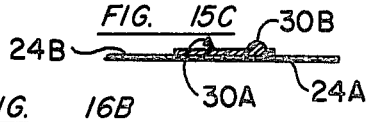
Figure 16A:
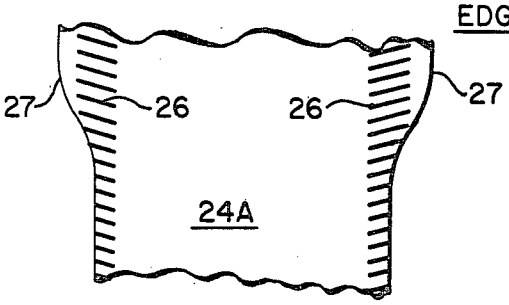
Figure 16B:
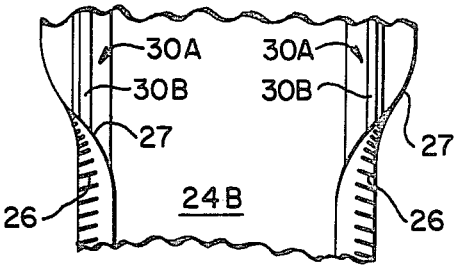
Figure 16C:
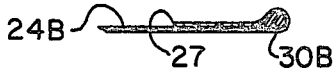
Figure 17A:
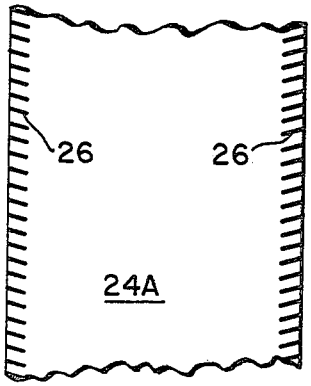
Figure 17B:
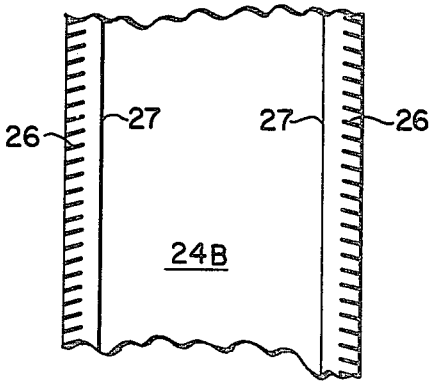

To provide added bulk along each fold line 28 by means other than cord 32, a continuous thin layer 30A of molten adhesive of the type described above may be deposited along each side edge 27 just inside fold lines 28 scored on strip 24 (FIG. 15). Each layer 30A of adhesive has a raised bead 30B of enlarged cross section (FIG. 15C) and extending parallel to longitudinal side edge 27 of strip 24. The side edges 27 of strip 24 are then folded over along their scored fold line 28 (FIGS. 16A and 16B) as previously described, and the marginal inner surfaces 24B between the fold lines 28 and side edges 27 are effectively bonded by the hot melt adhesive 30A with its raised bead 30B (FIG. 16C) providing the desired added bulk to the simulated headbands 44 of the linings 38 (FIG. 12). Thereafter, the heating step, if necessary, may be undertaken (FIGS. 17A and 17B) to reactivate or remelt the adhesive to securely seal the folded edges in position as described above.

Figure 18A:
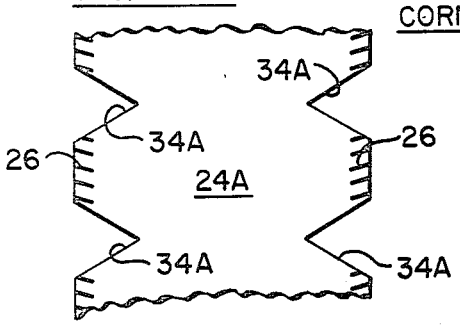
Figure 18B:
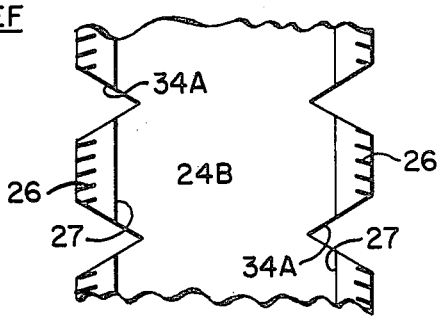

As illustrated in FIGS. 18A and 18B, the sealed and edge folded strip 24 then is relieved to provide cutouts 34A illustrated as being V-shaped. The cutouts 34A will be understood to be of any suitable shape to effect stress relief at each corner 48A of the side flaps 46 of the integrated lining 38 as previously described. The marginal cutouts 34A along each edge of the strip 24 may be produced by any suitable technique such as by burning or melting the strip 24 with a hot wire, e.g., or by punching.

Figure 19A:
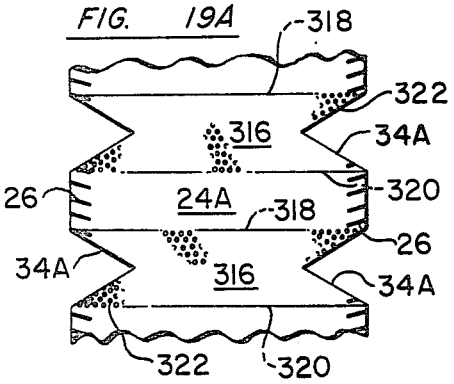
Figure 19B:
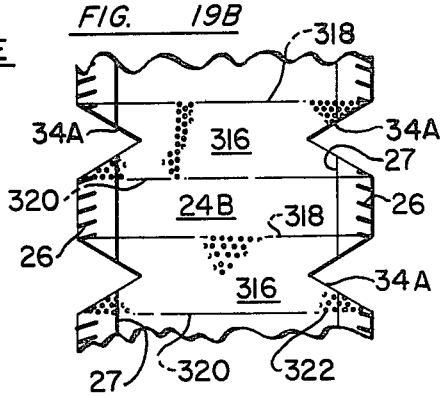
Figure 20A:
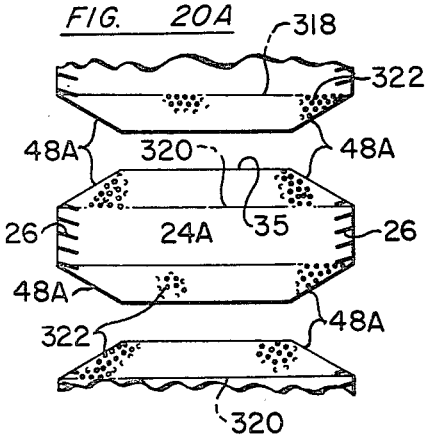
Figure 20B:
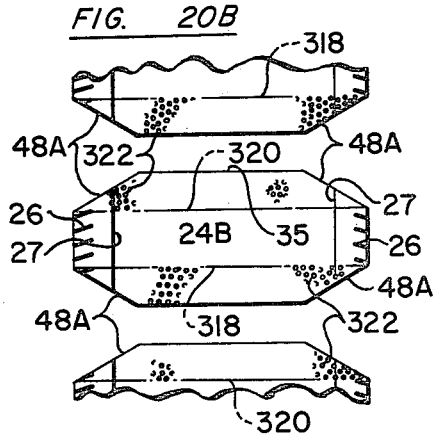

In accordance with yet another aspect of this invention, longitudinally spaced apart regions 316 of strip 24 (defined by aligned, opposed pairs of cutouts 34A and transversely extending projections 318, 320 between corresponding corners of the cutouts 34A as best seen in FIGS. 19A and 19B) are perforated. Perforation of these regions 316 provides for subsequent glue penetration through an otherwise impervious portion of the material of strip 24 which later define the side flaps 46 of the integrated lining 38. Accordingly, in a later operation of the book binding process following the cutting of the strip 24 (FIGS. 20A and 20B) and after the linings 38 have been applied to the books 36, only a single application of glue is required to bond not only side flaps 46 to end sheets 42 of each book 36 but also book 36 to its cover (not shown). Efficiency of such operation is achieved since glue permeating the side flaps 46 secures them to the end sheets 42 and the portion of the glue on the outside of the side flaps 46 glues the flaps to the book cover. By providing perforations 322 in the defined regions 316, later comprising side flaps 46, the same book making apparatus and method now used with conventional "crash" back lining may also be used with the integrated back lining 38 of this invention.

The perforations 322 in regions 316 are preferably sized and arranged to provide from about 40% to about 60% permeability of the material of each side flap 46.

It will be understood that other means of perforating strip 24 may be utilized, such as by either hot or cold punching or other techniques, for example, such as by hot wire melting of the strip 24 and the like.

As will be apparent to persons skilled in the art, various modifications, adaptations and variations of the foregoing specific disclosure can be made without departing from the teachings of this invention.

I claim:

1. An integrated book lining to be applied to a spine and end sheets of a book for securing book pages prior to casing-in the book with a cover, the book lining being an integral one-piece unit formed from a single sheet of substantially flat strip stock and comprising a generally rectangular sheet having opposite longitudinal ends folded toward one another with inner surfaces at each respective longitudinal end of the sheet being in confronting bonded relation to one another, the sheet having a folded length between its opposite longitudinal ends substantially equal to a length of a book spine to which the lining is to be applied, the sheet having a width between opposed side edges thereof which width is less than its folded length, the sheet having a longitudinally extending intermediate portion of a predetermined uninterrupted width substantially equal to the width of a book spine to which the lining is to be applied, and opposed side flaps respectively extending in opposite directions laterally beyond said intermediate portion and the opposed side edges of the sheet to be applied to end sheets of a book, and the corners of each of the side flaps of the sheet being relieved with corner cutouts defining each longitudinal end of said intermediate portion of the sheet of said predetermined uninterrupted width between the corner cutouts, said longitudinal ends of said intermediate portion of the sheet respectively having an outer surface printed with a simulated headband.

2. The lining of claim 1 wherein the strip stock comprises a tough, lightweight, durable sheet exhibiting dimensional stability with good printability and ink adhesiveness.

3. The lining of claim 1 wherein the strip stock is spunbonded olefin.

4. The lining of claim 1 wherein a bead of adhesive extends along a fold line at each longitudinal end of the sheet to provide bulk to each simulated headband.

5. The lining of claim 1 wherein the sheet material is impervious to glue, and wherein the side flaps are each perforated to provide glue penetration.

6. An integrated book lining formed from a single sheet of substantially flat strip stock and comprising a generally rectangular sheet of tough, lightweight, durable impervious spunbonded olefin material exhibiting dimensional stability with good printability and ink adhesiveness, the sheet having printed simulated headbands at its opposite longitudinal ends, the corners of the sheet being relieved with corner cutouts and having an uninterrupted width at each longitudinal end of the sheet between the corner cutouts substantially equal to the width of a book spine to which the lining to be applied, the ends of the sheet being folded with inner surfaces in confronting bonded relation to one another, the sheet having a folded length substantially equal to a length of a book spine to which the lining is to be applied, the sheet having opposed side flaps each extending laterally beyond the longitudinal ends of the sheet between the corner cutouts on their respective side of the sheet, the side flaps each being perforated to provide glue penetration.

7. The lining of claim 1 or claim 6 further including a cord extending along a fold line at each longitudinal end of the sheet to provide bulk to each simulated headband.

8. The lining of claim 6 or claim 5 wherein the side flaps are each perforated to provide about 50% permeability of the side flap material.

9. An integrated book lining to be applied to a spine of a book for securing book pages prior to casing-in the book with a cover, the book lining being an integral one-piece unit formed from a single sheet of substantially flat strip stock and comprising a generally rectangular sheet of tough, lightweight, durable spunbonded olefin material exhibiting dimensional stability with good printability and ink adhesiveness, the sheet having opposite longitudinal ends folded toward one another along a fold line with inner surfaces at each respective longitudinal end of the sheet being in confronting bonded relation to one another, the sheet having a folded length between fold lines at its opposite longitudinal ends substantially equal to a length of a book spine to which the lining is to be applied, the sheet having a predetermined width between opposed side edges thereof which width is less than its folded length and is substantially equal to the width of a book spine to which the lining is to be applied, the longitudinal ends of the sheet respectively having an exposed outer surface printed with a simulated headband along opposite sides of its fold line to form a continuous simulated headband pattern along each exposed longitudinal end of the sheet, and means extending along the fold line at each longitudinal end of the sheet to provide bulk to each simulated headband.

10. The lining of claim 9 further including a cord extending along a fold line at each longitudinal end of the sheet and comprising said means to provide bulk to each simulated headband.

11. The lining of claim 9 further including a bead of adhesive extending along a fold line at each longitudinal end of the sheet and comprising said means to provide bulk to each simulated headband.

* * * * *